US005136922A

United States Patent [19]

Piesik

[11] Patent Number: 5,136,922

[45] Date of Patent: Aug. 11, 1992

[54] SELF-ACTUATING ROCKET CHAMBER CLOSURES FOR MULTI-MISSILE LAUNCH CELLS

[75] Inventor: Edward T. Piesik, Pomona, Calif.

[73] Assignee: General Dynamics Corporation, Air Defense Systems Division, Pomona, Calif

[21] Appl. No.: 698,696

[22] Filed: May 13, 1991

[51] Int. Cl.[5] ..... F41F 3/077

[52] U.S. Cl. ..... 89/1.812; 89/1.816

[58] Field of Search ..... 89/1.812, 1.816, 1.8

[56] References Cited

U.S. PATENT DOCUMENTS

| | | | |
|---|---|---|---|
| 3,052,303 | 9/1962 | Lapp | 89/1.812 |
| 4,044,648 | 8/1977 | Piesik | 89/1.8 |
| 4,134,327 | 1/1979 | Piesik | 89/1.812 |
| 4,324,167 | 4/1982 | Piesik | 89/1.8 |
| 4,683,798 | 8/1987 | Piesik | 89/1.816 |
| 4,686,884 | 8/1987 | Piesik | 89/1.816 |
| 4,796,510 | 1/1989 | Piesik | 89/1.816 |
| 4,934,241 | 6/1990 | Piesik | 89/1.8 |

*Primary Examiner*—David H. Brown

*Attorney, Agent, or Firm*—Henry Bissell; Leo R. Carroll

[57] ABSTRACT

An exhaust gas management system for missile launch arrangements having multiple launch cells exhausting into a common plenum includes automatic aft closure members which serve to close off the flow passages to inactive cells while providing an open passage for exhaust gases from an active cell undergoing a missile firing. This arrangement prevents back flow or recirculation of exhaust gases into the volume in the cell which is upstream of the rocket nozzle exit.

10 Claims, 3 Drawing Sheets (ONE DOOR OPEN)

(BOTH DOORS OPEN)

(DOORS OPEN >90°)

SELF-ACTUATING ROCKET CHAMBER CLOSURES FOR MULTI-MISSILE LAUNCH CELLS

BACKGROUND OF THE INVENTION

1. Field of the Invention

The present invention relates to the field of controlled flow, exhaust manifold systems and, more particularly, to apparatus for controlling the flow of exhaust gases from a single missile being fired in a multi-missile canister and directed into a common exhaust gas manifold or plenum tube connected thereto.

2. Description of the Related Art

In certain military applications, particularly on warships having missile firing capability, the missiles are stored in a series of vertically oriented chambers closely adjacent one another. Exhaust gas outlets are normally provided to duct rocket exhaust gases generated during intended or accidental rocket ignitions to a safe location. In such installations, manifolding of a number of chambers into a common exhaust duct or plenum tube has become conventional.

There have been a number of approaches to the problems attendant upon the use of a common exhaust duct with a plurality of missile storage chambers. It is important to be able to block the exhaust gases from a missile which is being fired from blowing out through the individual chambers of other missiles. This is commonly accomplished by the use of doors or hinged panels which can open into the plenum chamber from the force of an impinging missile exhaust for the chamber containing the missile being fired and which can close off the passage at the base of a missile chamber opening into the exhaust plenum for other missiles.

Eastman U.S. Pat. No. 2,445,423 discloses apparatus having a plurality of individual missile chambers coupled to a common plenum chamber with a plurality of hinged, spring-loaded doors at the juncture of each individual missile chamber with the plenum tube. These doors open for a rocket that is being fired and serve to confine the exhaust gases within the plenum chamber and away from other missile-storage chambers.

There is also the problem of a portion of the rocket exhaust backing up into the chamber of the missile being fired and possibly over-pressurizing that missile chamber.

My own prior U.S. Pat. No. 4,044,648, the entire disclosure of which is incorporated by reference as though fully set forth herein, discloses a pair of hinged doors at the base of each missile storage chamber in the passage connecting the chamber to an associated exhaust plenum duct. The pressure forces on opposite sides of the doors during the firing of a missile are balanced to control the degree to which the doors are opened in order to adjust the opening to the varying dimension of the rocket exhaust stream as the missile rises and leaves the chamber upon firing. As a consequence, the rocket exhaust stream functions as a suitable "gas plug" in the opening in order to prevent recirculation of the exhaust gases back into the chamber undergoing firing.

It is important to control the rocket exhaust gas stream so that the gas plug is effective to prevent recirculation of exhaust gases back into the chamber. Control of the rocket exhaust stream on a dynamic basis to develop the gas plug effect appears to be more effective for the intended purpose than the use of fixed structure such as baffles, valves, diverters or the like which oftentimes have the undesirable result of interfering with the direct exhaust gas stream in their attempt to control flow, limit reverse circulation, etc. My prior U.S. Pat. No. 4,683,798, the entire disclosure of which is incorporated by reference as though fully set forth herein, discloses hinged doors near the lower end of each missile storage chamber but spaced from the juncture with the common plenum chamber by a transition region which provides a smooth transition from a generally square cross-section chamber in which a missile is stored and launched to a round exit opening in the chamber which connects with the exhaust plenum. This enhances the gas plug effect and uses it to prevent recirculation of exhaust gases back into the chamber of the missile being fired.

My prior U.S. Pat. No. 4,686,884, the entire disclosure of which is incorporated by reference as though fully set forth herein, discloses an arrangement including sets of doors to close off missile storage chambers coupled to a common plenum chamber upon the firing of a missile in another chamber with the addition of pivotable deflector panels which are installed in transition sections between the missile storage and launch chambers proper and the common plenum chamber.

Rocket exhaust gas management systems to which the present invention is related incorporate some of the principles which are applicable to the systems of my prior patents cited hereinabove. However, the present invention is intended for use in missile launch systems with multiple launch cells exhausting into a common plenum but with the cells arranged in clusters—e.g., by pairs—sharing common exhaust transition regions before reaching the juncture with the common plenum.

Where two or more missile launch cells share the same duct or flow channel leading into a common plenum, a single aft closure or door for each cell will protect the missile therein from recirculation of the exhaust of its own rocket motor or from exhaust gases from any other rocket which is fired in the launch system. The condition which is required for this arrangement to function properly is that the duct or flow channel leading into the plenum, in combination with the aft closure or door, present an exhaust flow area that causes a gas plug to be formed. This gas plug prevents gases from the plenum from flowing back into the active missile cell. The gas plug is formed when the momentum of the missile rocket exhaust is greater—at every radial position up to the confining wall of the duct and the door or aft closure—than the momentum of the plenum gases flowing back toward the active missile cell opening.

It is important that the aft closure or door be able to open quickly in response to the initial pressure of exhaust gases from the rocket when it is ignited and also to adjust automatically the effective size of the exhaust opening to maintain an effective gas plug as the dimensions of the exhaust plume change, as for example when the missile is flying out of the canister. In addition, the aft closure or door should be capable of closing automatically, preferably in response to gas pressure in the plenum chamber, for those canisters which are not undergoing a missile firing.

SUMMARY OF THE INVENTION

In brief, arrangements in accordance with the present invention comprise aft closure arrangements for multi-missile launch systems incorporating a plurality of launch cells exhausting into a common plenum. The construction of systems in which embodiments of the invention are installed is such that the minimum flow area for exhaust gases resides in the canister or cell from which the fired missile is being launched. This flow area is such that, during the missile traversal of the launch canister, the supersonic rocket exhaust flow cannot negotiate the minimum flow area without "choking". "Choking" occurs when the product of the flow density and velocity is less than the mass flow rate per unit flow area, as described by the Continuity Equation. At the onset of "choke" conditions, the velocity at the minimum flow area has a Mach number which is just equal to 1.0. For some distance upstream, the flow is subsonic with the recovery pressure more than twice the pressure downstream of the minimum flow area.

Such multi-missile launch cells involve rocket exhaust flow that expands to fill the designed channel area downstream of the rocket nozzle exit, even when opposed by the pressure which exists at or beyond the channel exit. Such systems thus prevent any back flow or recirculation of exhaust flow into the volume which is upstream of the rocket nozzle exit. The area downstream of the rocket nozzle is equal to or greater than the nozzle exit and is constant or increasing in size as a function of distance downstream from the nozzle. Arrangements in accordance with the present invention are specifically designed to protect multi-missile canisters and the missiles therein during any normal or restrained missile firing in a Vertical Launcher System (VLS).

Specific embodiments of the present invention comprise a single closure door near the aft end of each cylindrical launch cell in a multi-missile canister. The door is hingedly mounted to open into a transition section mating with the VLS plenum. The door opens under the influence of gas flow exhausting from an active rocket nozzle. The flow area through the door is not the restricting area in the system, but rather this is the minimum flow area as described hereinabove. The door is arranged to close under pressure from any opposing gas flow which is directed toward the rocket nozzle when the rocket is inactive. Upon reclosure, the door may latch and lock ' place to isolate that cell from the remaining launch environment. A pair of such doors are mounted to pivot on a common hinge in a dual-missile canister system.

The doors or aft closures function automatically under the influence of the exhaust gases flowing in the launch system. A corresponding door is forced open when the active cell rocket is fired. When gases flow in the reverse section, toward the open cell, the door is forced closed.

Because the opening cycle may be very rapid and a substantial momentum may be imparted to the opening door or aft closure, particular structure is provided in accordance with an aspect of the invention to absorb the momentum. Such structure may comprise compression springs, shock absorbers, crushable material, or a combination of such elements.

In accordance with a further aspect of the invention, the doors or aft closures are constructed with a particular configuration which reacts to reverse gas flow toward the open cell so as to close the door automatically. This door configuration includes one or more triangular plates or other means which are effective to space the doors from each other when one is in the open position, thereby providing a stagnation region behind the open door which develops a greater force on the back side of the door than on the front when there is reverse gas flow from the plenum in the direction of the open cell. Gases flowing from the plenum toward the cell are directed toward the stagnation region along the back side of the door, thereby developing a pressure area force on the back side of the door which is greater than the pressure area force on the front side of the door. Automatic closure of the door under these conditions will be achieved as long as the angle of the front face of the door or aft closure when in the open condition is less than 180 degrees (relative to zero degrees in the fully closed position). The preferred angle of the front face of the door or aft closure in the open condition is 135 degrees or less. Under these conditions, because the gases flowing toward the open cell have velocity, the front side door pressure is less than the pressure of the stagnated gases on the back side and the door is forced closed automatically.

BRIEF DESCRIPTION OF THE DRAWINGS

A better understanding of the present invention may be realized from a consideration of the following detailed description, taken in conjunction with the accompanying drawing in which.

DETAILED DESCRIPTION OF THE PREFERRED EMBODIMENTS

Figure 1:
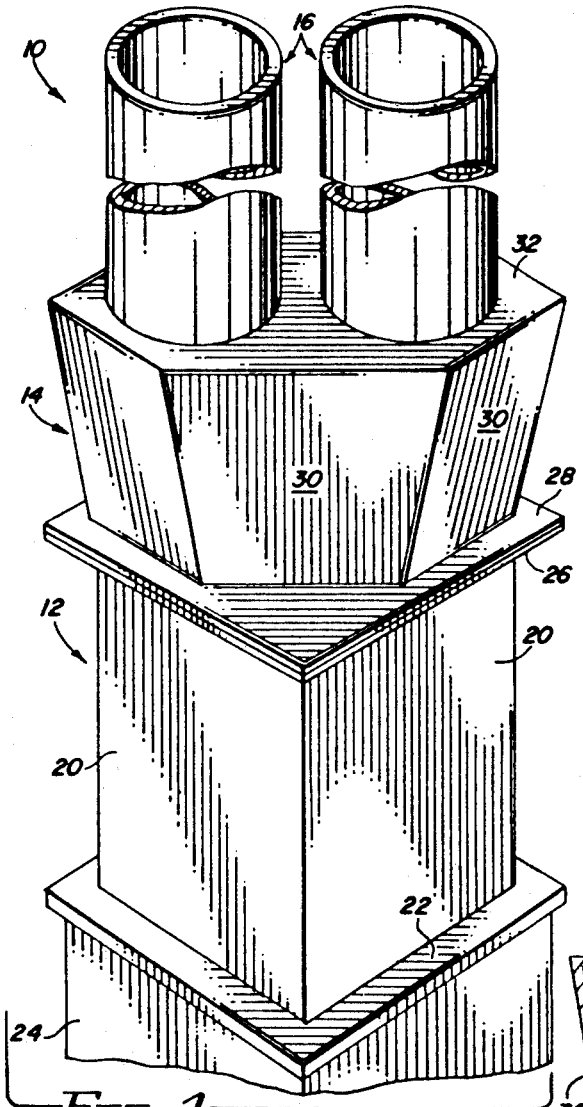
FIG. 1 is a perspective view of a multi-missile canister system of a type in which my invention may be used.
Figure 2:
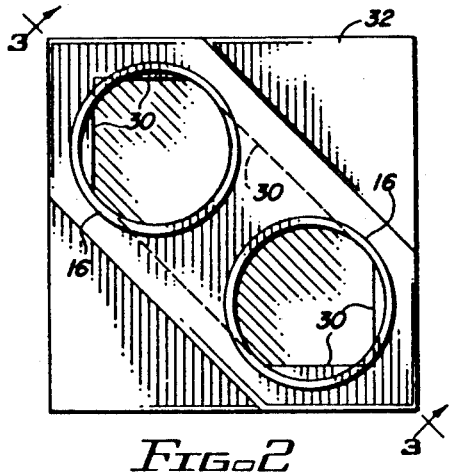
FIG. 2 is a plan view of the arrangement of FIG. 1.

FIGS. 1–4 are taken from my co-pending application Ser. No. 07/698,769, entitled MULTI-MISSILE CANISTER GAS MANAGEMENT SYSTEM, the disclosure of which is incorporated herein by reference as though set forth in haec verba, and represent one particular embodiment thereof. My present invention is designed to be used in multi-missile canister systems of the type disclosed in that application.

In FIGS. 1–4, a system 10 is shown comprising a lower transition section 12, an upper transition section 14 and a pair of missile canisters or cells 16 which sit atop the section 14. The section 12 is a generally square (or rectangular) with adjacent sidewalls 20 joined at right angles and provided with a bottom flange 22 which serves to couple the system to an associated plenum chamber 24.

The lower transition section 12 terminates in an upper flange 26 which is joined to a plate 28 to which the upper transition portion is attached. Vertically angled sidewalls 30 extend upwardly from the plate 28 to a second plate 32, to which the missile canisters 16 are attached. Adjacent sidewalls 30 are joined together, forming a six-sided configuration of the upper transition section 14. The upper plate 32 is provided with a pair of circular openings 34 to connect the interior volumes of the two missile canisters 16 with the upper transition portion 14. The plate 28 is provided with an opening 38 shaped to match the lower cross-sectional outline of the transition section 14 which serves to connect the interior spaces of the two transition portions 12 and 14. A tapered skirt 40 projects downwardly into the upper portion of the lower transition section 12, substantially continuing the angle with the vertical which is made by the walls 30 of the upper transition section 14.

Figure 3:
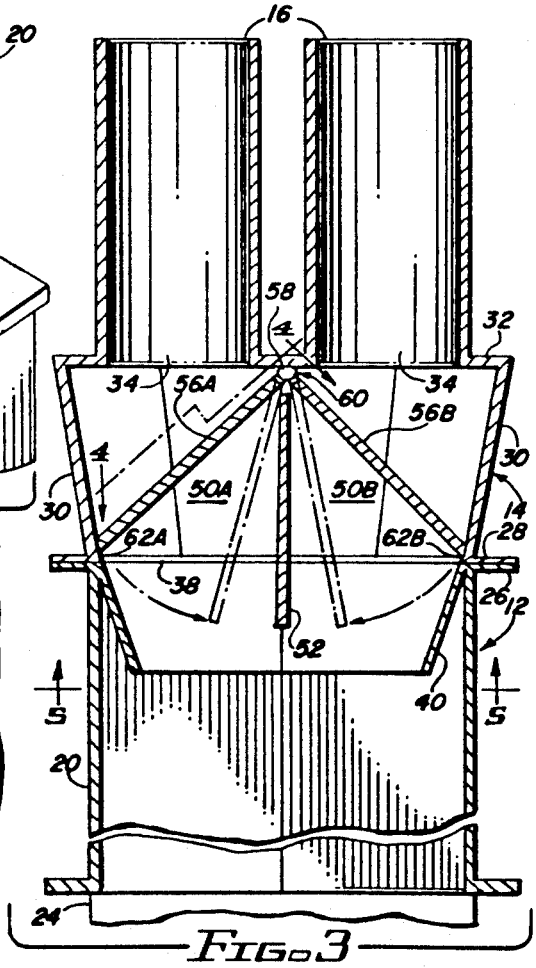
FIG. 3 is a sectional elevation of the multi-missile canister system of FIG. 1, taken along the line 3—3 of FIG. 2 and looking in the direction of the arrows.

The upper transition portion 14 is divided into two compartments 50A and 50B by a transverse vertical plate 52 which extends across the interior of the transition section 14 between opposed sidewalls 30 in a plane which is orthogonal to a plane defined by the two longitudinal axes of the missile canister 16 (the plane of the paper in FIG. 3). This transverse vertical plate 52 extends from near the top of the upper transition section 14 into the space encompassed by the skirt 40.

Figure 4:
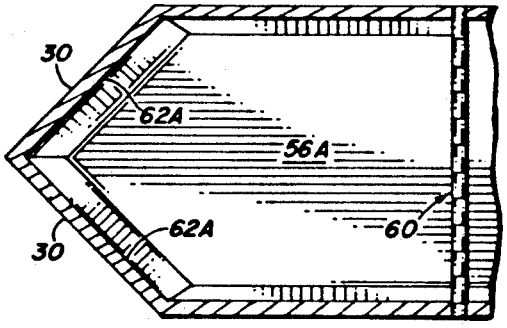
FIG. 4 is a view of a portion of FIG. 3 lying along the line 4—4 of FIG. 3 and looking in the direction of the arrows.

In each of the spaces 50A, 50B there is a hinged door, 56A or 56B. These two doors 56A, 56B are hinged to swing about a pivot point 58 by hinge mechanism 60. The doors 56A, 56B are shown in solid outline form in FIG. 3 in the closed position, wherein the terminal edge of a door, 62A or 62B, abuts against the lower edge of adjacent walls 30 of the upper transition section 14. This is best shown in FIG. 4, wherein the outline of the door 56A is depicted as shaped to match the hexagonal cross section of the upper transition section 14 at the angle of juncture. The doors 56A and 56B are shown in broken outline form in FIG. 3 as they transition from the fully closed position to the fully open position in which they rest flat against the vertical plate 52. It will be noted that the plate 52 extends to the lower edge of the doors 50A, 50B when the doors are in the fully open position. When in the closed position, the doors 50A, 50B completely block off the transfer of any exhaust gases upward into the missile cylinders 16 from the exhaust plenum. In the operation of the system 10, these doors open one at a time to permit exhaust gases from a missile being fired in one of the missile cylinders 16 to flow downwardly into the exhaust plenum 24 through the transition sections 12, 14 while limiting or preventing any reverse flow or recirculation back into the cell 16.

Figure 5:
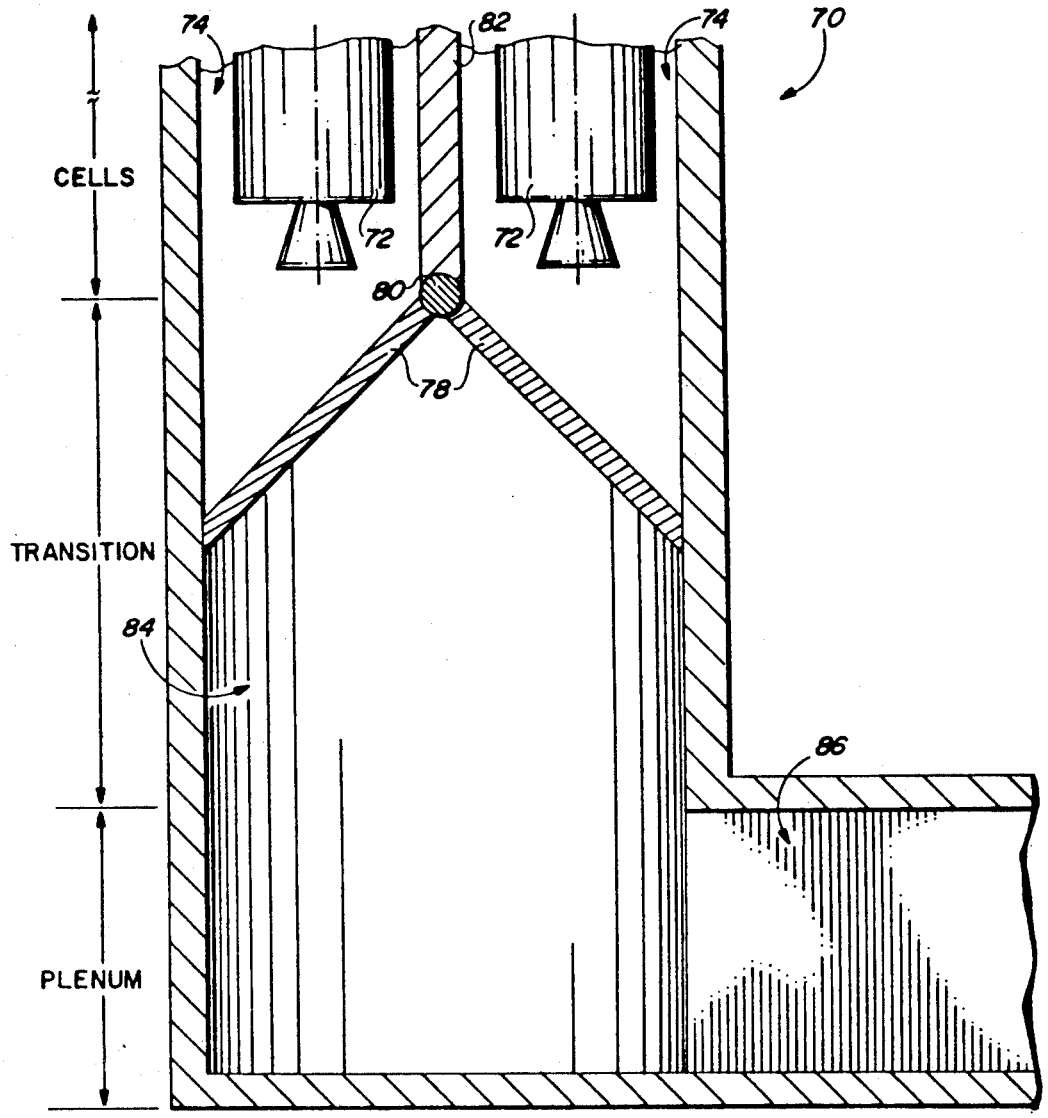
FIG. 5 is a schematic view corresponding to that of FIG. 3 with certain modifications.

FIG. 5 is a schematic diagram representing a system like that of FIGS. 1–4 but modified to accommodate arrangements in accordance with the present invention. In FIG. 5, a multi-missile canister system 70 is shown having a pair of missiles 72 installed within a pair of cells 74 of a common canister 76. Each of the cells 74 is provided with an aft closure 78 pivotably mounted by a hinged mechanism 80 to the lower edge of the common wall 82 between the two cells 74. It will be noted that there is no divider wall below the hinge 80 between the two aft closures 78.

The system 70 of FIG. 5 is shown with a single transition section 84 extending below the cells 74 from approximately the location of the hinge mechanism 80 to the point where it joins a plenum 86. For simplification, the system of FIG. 5 is represented as though the missile cells 74 were square with rectilinear aft closures 78 and the transition section 84 were square or rectangular, rather than having the shapes and configurations shown in FIGS. 1–4. However the principles of my invention are applicable to such configurations, even though described hereinafter in the context of square aft closures, transition sections, exhaust chambers, etc.

Figure 7A:
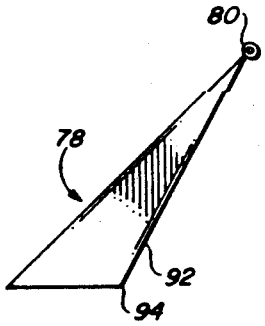
FIG. 7, views A, B and C, shows orthogonal views in schematic form of an arrangement in accordance with the present invention.
Figure 7B:
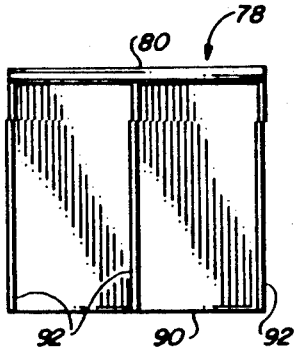
Figure 7C:
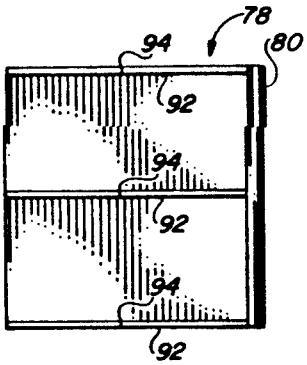
Figure 8:
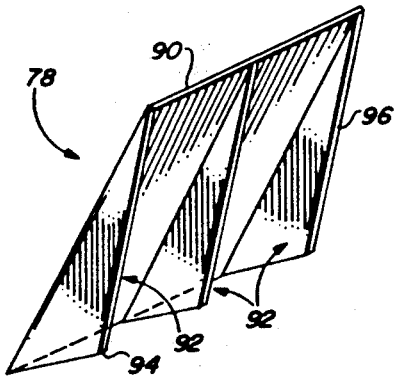
FIG. 8 is a schematic perspective view of the arrangement depicted in FIG. 7.

Particular details of the construction of the aft closures 78 are shown in FIGS. 7 and 8. The angle these aft closures, when closed, make with the axes of the cells 74 may vary in accordance with the cross sectional dimension of the cells and the size of the doors or aft closures 78. The angle is preferably 45 degrees to the axis of the associated cell; however, it may be greater or less if desired.

Figure 6:
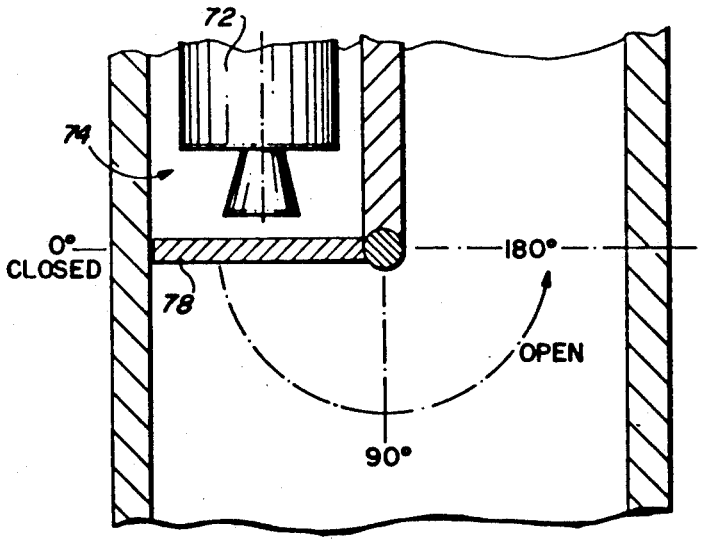
FIG. 6 is another schematic view showing a side elevation of a multi-missile canister system.

FIG. 6 is a schematic diagram which is included herein to establish a reference for the door angle. This shows an aft closure 78 for a cell 74 containing a missile 72, wherein the relative dimensions of the cross section of the cell 74 and the extent of the door or aft closure 78 are such that the door 78 is perpendicular to the centerline axis of the cell 74 when the door 78 is fully closed. For the configuration depicted in FIG. 6, the door 78 is at an angle of 0 degrees, relative to movement of the door 78. In opening, the door 78 can move to a 90 degree angle, at which it is fully open for the associated cell 74, and it can move past 90 degrees to approach 180 degrees, where it would contact or be aligned with the closed door in the other cell. However, as will become apparent hereinafter, aft closures 78 are prevented from opening a full 180 degrees by structural configurations in accordance with my invention.

Particular details of the structural configuration of the aft closure 78 are shown in FIGS. 7 and 8, wherein the closure 78 is shown comprising a door plate 90 to which a plurality of spacer plates 92 are attached at right angles, as by welding, and extending outward (i.e., backwardly or downwardly) from the back side of the door plate 90. Each spacer plate 92 is generally triangular in shape with its two back edges meeting at a corner 94, preferably forming an obtuse angle. The longer rearward edge 96 abuts against the corresponding rearward edge of the other aft closure of the adjacent cell in the multi-missile canister. The spacer plates 92 prevent the door plates 90 of two commonly hinged aft closures 78 from ever touching in a back-to-back juxtaposition, thereby serving to develop a stagnation space between the plates 92 which, in response to gas flow which is directed into the stagnation area, automatically closes the aft closure(s) 78.

Figure 9A:
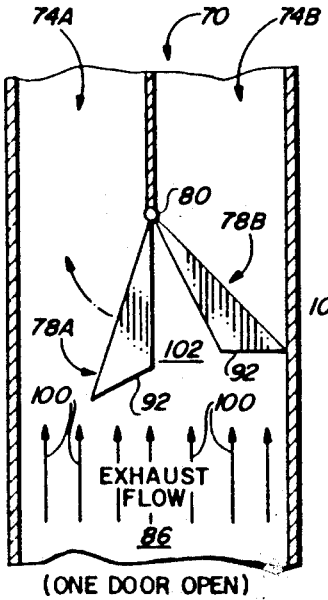
FIG. 9, views A, B and C, are schematic elevational views depicting the operation of arrangements in accordance with my invention.
Figure 9B:
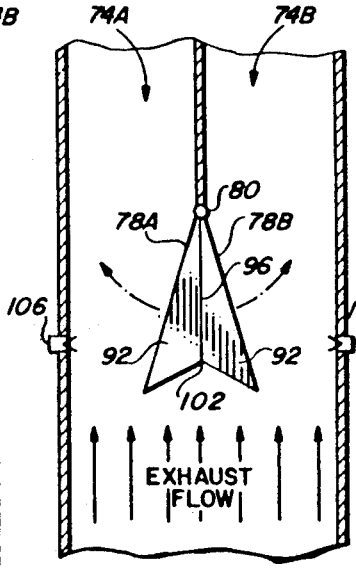
Figure 9C:
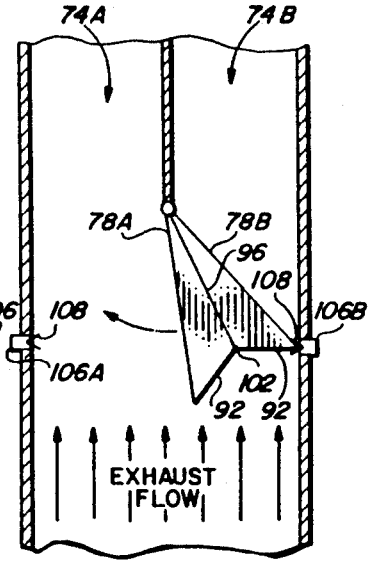

Operation of the structure of FIGS. 7 and 8 is depicted in the schematic views A, B and C of FIG. 9. In view A, two doors 78A and 78B of a common multi-missile canister system 70 are shown with one door 78A being open and the other 78B closed. Exhaust gas flow is indicated by the arrows 100 directed toward the open cell 74A from an associated plenum 86. These exhaust gases flow into a stagnation area 102 between the two doors 78A, 78B as defined (at a minimum volume) by the spacer plates 92. This maintains the aft closure 78B in the closed position and drives the aft closure 78A to close the aft opening of cell 74A.

FIG. 9B shows a corresponding arrangement with both aft closures 78A and 78B in the open position. In this view, it may be seen how the stagnation region 102 is maintained by the spacer plates 92 which abut at the rearward edges 96. With both doors open as shown in view B, exhaust flow from the associated plenum chamber is driven into the stagnation chamber 102 where it develops the forces necessary to close both doors 78A and 78B.

View C of FIG. 9 shows a situation where the door 78B is fully closed and the door 78A is in the maximum open position, with the longer edge 96 of its spacer plate 92 abutting against the corresponding edge 96 of the spacer plate 92 of door 78B. Even in this fully open position, the pressure force against the back side of the door 78B from the influence of reverse exhaust flow directed into the stagnation space 102 is sufficient to cause the aft closure 78A to close automatically.

It will be understood that the rigid doors 78 are ablatively protected on both the top (missile side) and bottom (plenum side) surfaces with the top surface being provided with greater ablative protection in order to be able to withstand restrained firing exhaust impingement. The hinge mechanism 80 is shadowed from any direct exhaust impingement, but is ablatively coated as needed to provide protection from upwardly flowing exhaust gases from adjacent cell firings. Since certain ablative materials are non-charring, ablatively effective, flexible and reject aluminum oxide deposition under rocket exhaust impingement, an effective seal of the active cylinder aft end can be maintained prior to and after active cell rocket motor firing. A material bearing the designation REFSET L3203-6 is an example of a suitable ablative for this purpose.

A re-latch capability may be provided so that one of the doors in the multi-missile canister will re-latch upon firing in the next adjacent cell. Such re-latching is possible as a result of the pressure pulse which is imposed on a multi-missile vertical launch system at rocket motor ignition. This door re-latching capability is a one-time function. The re-latching mechanism is activated as the door is opened by the active cell rocket exhaust and latches and locks upon door closure which results from the firing pressure pulse in an adjacent cell. Once latched, the cell is isolated from the vertical launch system environment for all additional firings.

Figure 10:
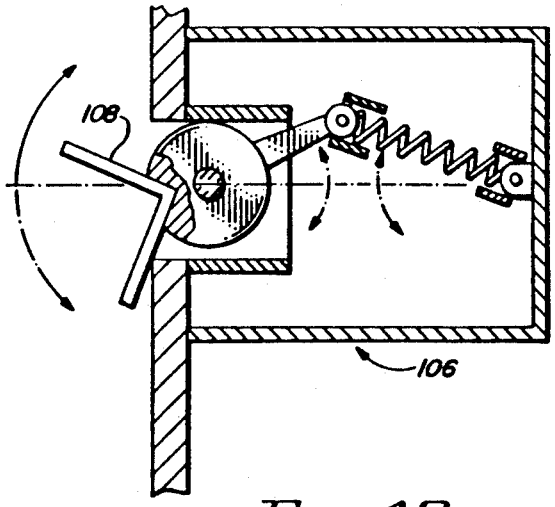
FIG. 10 is an enlarged sectional view of a particular element in FIG. 9, views B and C.

Such a latching mechanism 106 is shown in views B and C of FIG. 9 and in the enlarged sectional view of FIG. 10 as comprising a block 106 mounted on the wall of the associated cell and having a toggle retainer 108. The retainer 108 is spring-loaded to maintain the position which is assumed at the moment, either open as shown for block 106A, or closed, as shown for 106B. Latched retainer 106B is shown retaining aft closure 78B in the closed position. However, upon the firing of a missile in the associated cell 74B, the resistance of the internal spring-loaded mechanism of 106B is overcome and the retainer 108 is flipped toward the open position, thereby allowing the aft closure 78B to open.

The disclosure of my above-referenced co-pending application filed concurrently herewith entitled MULTI-MISSILE CANISTER GAS MANAGEMENT SYSTEM, which disclosure is incorporated herein by reference, includes an additional embodiment having a group of four missile cells assembled and arranged for firing, one at a time, from a common group with a rocket motor exhaust being directed to the associated plenum through a common transition section. It will be understood that aft closure structural configurations in accordance with the present invention may be employed in such multi-missile canisters as well, and that the present invention is not limited to the use of the special aft closure configurations of my invention in a dual-missile canister system.

Thus, as shown and described hereinabove, particular arrangements in accordance with the present invention provide specific improvements for multi-missile canister, vertical launch systems wherein the plurality of canisters are coupled to a single port of an exhaust gas plenum in a shipboard installation or the like. The disclosed embodiments include aft closures for the individual canisters of a multi-cell system which move to the open position under the influence of exhaust gases in the cell undergoing ignition while at the same time acting to close off other cells in the system and thereby prevent the upward flow of exhaust gases into those other cells. Operation of the end closures is automatic under the influence of the gas pressures on opposite sides of an individual door. Thus, improved control of exhaust gas flow and limitation of reverse circulation into a cell undergoing firing provide protection to the missiles and prevent the application of excessive gas pressures in the cells.

Although there have been described hereinabove various specific arrangements of self-actuating rocket chamber closures for multi-missile launch cells in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the annexed claims.

What is claimed is:

1. Self-actuating closure apparatus for a multi-missile launch system wherein at least two cells for containing missiles are arrayed side-by-side and exhaust into a common exhaust chamber, said apparatus comprising:

at least a pair of adjacent opposed aft closures individually associated with said at least two cells, said closures being pivotably mounted at a common hinge mechanism situated between said cells and equidistant from the central axes thereof, said closures extending downwardly and outwardly from said common hinge mechanism to a region of contact with a wall of an associated cell at an acute angle with the axis of said cell; and means for controlling exhaust gas flow to automatically drive an open aft closure from an open position toward the closed position and to maintain a closed aft closure in the closed position in response to reverse exhaust gas flow toward said aft closure from an adjacent exhaust chamber, said controlling means including means for establishing a gas stagnation region between a pair of adjacent opposed aft closures when one of the aft closures is in an open position, said gas stagnation region being effective to drive said one aft closure away from the other aft closure and toward the closed position upon exhaust gases being directed into said stagnation region.

2. The apparatus of claim 1 wherein said pair of adjacent opposed aft closures each comprises a rigid material door plate hinged along one edge to open and close the exhaust end of the associated missile cell, said door plate having a front side facing toward the missile cell and a back side facing away from the missile cell, wherein said means for establishing a gas stagnation region comprise at least one spacer plate mounted on said door plate to project from the back side of said door plate in a position to contact the other door of said pair when one of said aft closures is in the open position, said contact preventing the two door plates from closing against each other and maintaining a stagnation region between the two door plates.

3. The apparatus of claim 2 wherein said at least one spacer plate is triangular in shape with the longer side of said shape being welded to the back side of said door plate at approximately 90 degrees to the door plate.

4. The apparatus of claim 3 wherein at least one spacer plate comprises three spacer plates mounted respectively at each side edge and the middle of the door plate.

5. The apparatus of claim 4 wherein said three spacer plates are shaped alike and mounted in parallel alignment with sufficient space between them to establish a pair of stagnation pockets for exhaust gases flowing in the reverse direction toward an open missile cell and associated aft closure.

6. The apparatus of claim 5 wherein said spacer plates of respective aft closures of an adjacent opposed pair are aligned on their corresponding door plates so as to contact each other in abutting relationship when one of said aft closures rotates to the position of the other aft closure.

7. The apparatus of claim 6 further including means for releasably latching the aft closure in the closed position.

8. The apparatus of claim 7 wherein said releasable latching means comprises a block mounted on the sidewall of the missile cell and including a retaining member for gripping and retaining the aft closure when it is in the closed position.

9. The apparatus of claim 8 wherein said releasable latching means include spring-loaded means installed within said block for maintaining the retaining member in closed position, once moved to that position.

10. The apparatus of claim 9 wherein the releasable latching means further includes a toggle member coupled to the spring-locked means to switch the retaining member to a closed position.

* * * * *